US006717090B2

(12) United States Patent
Kling et al.

(10) Patent No.: US 6,717,090 B2
(45) Date of Patent: Apr. 6, 2004

(54) ARC QUENCHING CONFIGURATION FOR AN ELECTRICAL SWITCHING DEVICE

(76) Inventors: Klaus Kling, IM Wiesengrund 29, D-69250 Schönau (DE); Richard Kommert, Heckerstrasse 37, D-69124 Heidelberg (DE); Alexander Rab, Adlerstrasse 1, D-69190 Walldorf (DE); Jürgen Hofmann, Promenadenweg 37, D-64683 Einhausen (DE); Patrick Claeys, Viktoriastrasse 22, D-64293 Darmstadt (DE)

( * ) Notice: Subject to any disclaimer, the term of this patent is extended or adjusted under 35 U.S.C. 154(b) by 0 days.

(21) Appl. No.: 10/298,430

(22) Filed: Nov. 18, 2002

(65) Prior Publication Data

US 2003/0094439 A1 May 22, 2003

(30) Foreign Application Priority Data

Nov. 16, 2001 (DE) ..... 101 56 519
Sep. 12, 2002 (DE) ..... 102 42 310

(51) Int. Cl.[7] ..... H01H 33/08

(52) U.S. Cl. ..... 218/151; 218/149; 218/34; 218/15

(58) Field of Search ..... 218/149, 150, 218/7, 34, 15, 36, 38, 40, 41, 151–158; 335/201, 202

(56) References Cited

U.S. PATENT DOCUMENTS

| | | | | | |
|---|---|---|---|---|---|
| 4,143,256 | A | * | 3/1979 | Ciarcia | 218/151 |
| 4,405,847 | A | * | 9/1983 | Morton | 218/149 |
| 4,609,797 | A | * | 9/1986 | Morton et al. | 218/151 |
| 4,612,426 | A | * | 9/1986 | Maier et al. | 218/151 |
| 4,650,938 | A | * | 3/1987 | Genba | 218/149 |
| 4,656,446 | A | * | 4/1987 | Chien et al. | 335/201 |

FOREIGN PATENT DOCUMENTS

| | | |
|---|---|---|
| DE | 26 16 825 | 10/1977 |
| DE | 31 49 750 C2 | 7/1982 |
| DE | 32 47 681 A1 | 6/1984 |
| DE | 195 18 049 A1 | 11/1996 |
| DE | 199 24 414 A1 | 11/2000 |

* cited by examiner

*Primary Examiner*—Lincoln Donovan
*Assistant Examiner*—M. Fishman

(57) ABSTRACT

An arc quenching configuration for an electrical switching device has an arcing chamber in which an arc is produced between a stationary contact piece and a moving contact piece during a switching operation. An arc splitter stack is provided and has a number of arc splitter plates and into which the arc is passed via guide rails. At least one plate composed of an insulating material is disposed in or adjacent to the arc splitter stack, an external circumference of the plate does not project beyond the external circumference of the arc splitter plates, and the plate has an internal recess.

14 Claims, 5 Drawing Sheets

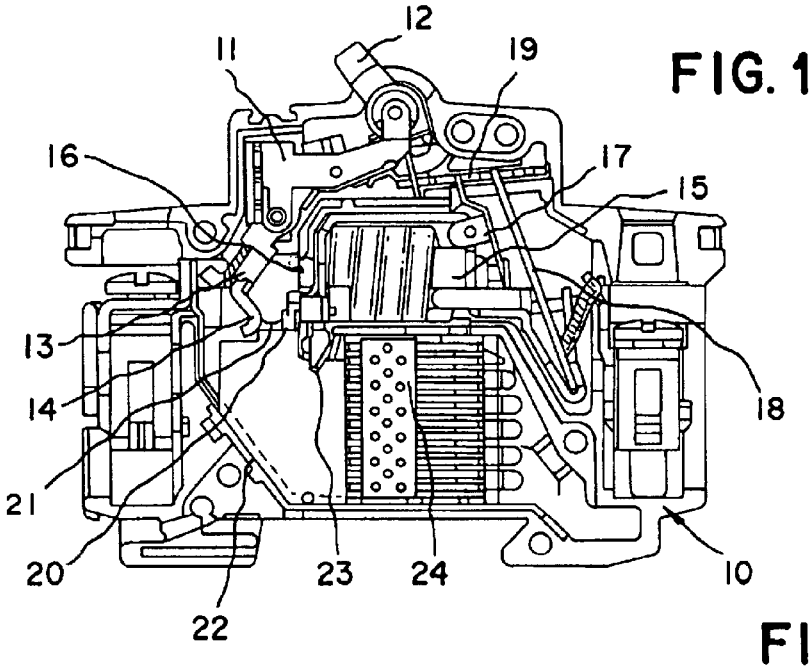
FIG. 1
FIG. 2
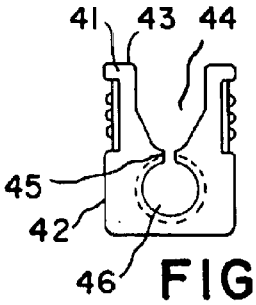
FIG. 4
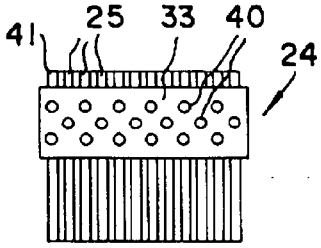
FIG. 3
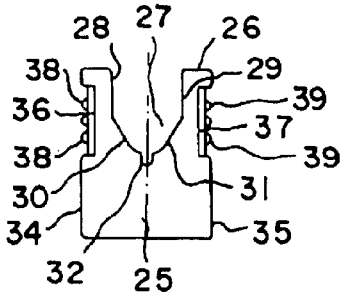
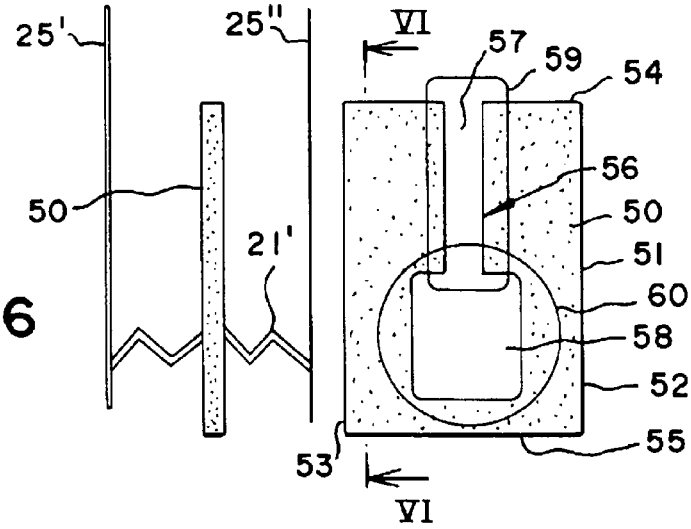
FIG. 5
FIG. 6

ARC QUENCHING CONFIGURATION FOR AN ELECTRICAL SWITCHING DEVICE

BACKGROUND OF THE INVENTION

Field of the Invention

The invention relates to an arc quenching configuration for an electrical switching device. The electrical switching device has a dielectric material enclosure, which is assembled from a lower part and an upper part in a plane parallel to its width faces, as well as input and output connections between which a current path having at least one contact point is located. The contact point must be opened in the event of an over-current or a short-circuit current. Any arc which occurs in the contact point, which may have either a stationary contact piece and a moving contact piece or two fixed contact pieces (disposed at a distance from one another) and a contact link with moving contact pieces, is fed during a disconnection operation to an arc splitter stack, in which the arc is quenched.

Circuit breakers preferably have a contact point, with the moving contact piece being disposed on a contact lever; motor circuit breakers preferably have two stationary contact pieces, which are bridged by a contact link. Where there is one contact point, only one arc splitter stack is provided while, in contrast, where there is a double contact point, two such stacks are provided. The arc splitter stack has a number of arc splitter plates, which are held at a distance from one another by insulating paper; the individual arc splitter plates subdivide the arc into small individual arcs, thus resulting in an increased arc voltage, which is in the opposite direction to the power supply system voltage and ensures current limiting. The greater the number of plates, the higher the arc voltage can be. However, this is dependent on the arc remaining stable in the arc splitter plate chamber. When a number of plates are used, there is a high risk of the arc sections being short-circuited at the side, at the rear or else in front of the plates, thus resulting in a smaller arc voltage, with the arc voltage oscillating severely. Furthermore, there is a risk of the arc not burning in a stable manner in the arc splitter plate chamber, but in fact being able to have a tendency to run out of the deionization chamber, so that the mean arc voltage is reduced, and oscillates once again.

In order to improve the stable burning of the arc within the arc splitter stack, it has become known for at least one arcing plate to be coated with a suitable plastic layer. Thus, once the foot of the arc has run into the deionization chamber, it is stabilized in the chamber.

If the coating material is a gas-releasing material, the gas pressure within the arc splitter stack can be increased, thus also increasing the arc voltage since a gas atmosphere exists between the coated arc splitter plates, and this can be used to increase the arc voltage that exists there.

SUMMARY OF THE INVENTION

It is accordingly an object of the invention to provide an arc quenching configuration for an electrical switching device that overcomes the above-mentioned disadvantages of the prior art devices of this general type, which improves even further the arc quenching configuration of the type mentioned initially.

With the foregoing and other objects in view there is provided, in accordance with the invention, an arc quenching configuration for an electrical switching device. The electrical switching device has a dielectric material enclosure with side faces and formed from a lower part and an upper part in a plane parallel to the side faces. The arc quenching configuration contains a stationary contact piece, a moving contact piece, and an arcing chamber for producing an arc between the stationary contact piece and the moving contact piece during a switching operation. The stationary contact piece and the moving contact piece are at least partially disposed in the arcing chamber. Guide rails are provided and lead from the arcing chamber. An arc splitter stack has a number of arc splitter plates and is disposed downstream of the guide rails. The arc passes between the guide rails into the arc splitter stack. The arc splitter plates have a given external circumference. At least one further plate composed of an insulating material is disposed in or adjacent to the arc splitter stack. The at least one further plate has an external circumference corresponding substantially to the given external circumference of the arc splitter plates. The at least one further plate further has an internal recess formed therein.

Accordingly, the at least one plate is composed of insulating material and is preferably located inside or outside the arc splitter stack and its external circumference can project beyond the external circumference of the arc splitter plates, and it has an internal recess.

According to one preferred refinement of the invention, the internal recess may have an inlet constriction area and a widened area, of which the inlet constriction area is open to the contact point.

The configuration results in that the conditions within the arc splitter stack can be monitored more efficiently and the individual parameters can be better matched to one another.

Furthermore, an optimized gas pressure can be produced within the arc splitter stack by the plate having a suitable thickness and by a suitable choice of materials, so that the arc voltage between the individual arcing plates is increased without, however, the arc being passed back to the contact point as a result of an excessively high gas pressure. This makes it possible to better monitor the stable burning of the arc within the arc splitter stack, the arc voltage is increased and, in consequence, the prospective short-circuit current is limited better and more safely.

The plastic PA 6 or else the plastic PA (6—6) may be used, by way of example, as the material whose gas releasement is optimum for the purpose of arc quenching.

According to a further embodiment of the invention, the inlet constriction area may have straight boundary edges; however, it could also widen in a V-shape toward the contact point.

The widened area of the internal recess may have an approximately rectangular or, possibly, also an approximately circular internal contour.

It could also be state that the internal recess is keyhole-shaped.

In one particular embodiment of the invention, the at least one plate is fitted such that it bounds the arc splitter stack on one side.

A further refinement according to the invention provides for the at least one plate composed of insulating material to be integrally formed entirely or partially on the inner face of at least one part of the dielectric material enclosure of the electrical switching device. For the assembly process, this offers the advantage that a standard arc splitter stack can be used, which is inserted into the enclosure such that the plate, which is integrally formed on the inner face of the enclosure, bounds the arc splitter stack on a side. There is no need to modify the arc splitter stack itself, because the plate composed of the insulating material is integrally formed as a part of the enclosure, on its inner face, and is also composed of the same material as the enclosure.

One particularly advantageous refinement option for the fitting of the plate according to the invention provides that the plate is divided into two halves along a division axis which runs parallel to its longitudinal sides and between them, with in each case one of the two halves being integrally formed on the inner face of one of the two dielectric material enclosure parts. When the dielectric material enclosure containing the upper part and lower part is joined together, the two plate parts are then joined together along the division axis, seamlessly, to form the complete plate. The two plate parts are in this case joined together, in particular, such that the way in which their external contours are joined together forms the internal contour of the internal recess in the plate.

The particular advantage of the invention is that the switching capacity is improved and increased, and the disconnection response is stabilized; furthermore, the air gaps and creepage distances can be increased in an configuration with an arc quenching chamber between the contact pieces, with an elongation which is used as a guide rail.

The invention can be used in all switching devices in which an arc that occurs during a switching operation is quenched by a quenching device, or serves to stabilize the arc at a specific point.

Other features which are considered as characteristic for the invention are set forth in the appended claims.

Although the invention is illustrated and described herein as embodied in an arc quenching configuration for an electrical switching device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a diagrammatic view into an electrical switching device according to the invention;

FIG. 2 is a plan view of an arc splitter plate;

FIG. 3 is a side-elevational view of an arc splitter stack, which contains a number of arcing plates corresponding to that shown in FIG. 2;

FIG. 4 is a plan view of a first refinement of an insulating plate;

FIG. 5 is a plan view of a second embodiment of the insulating plate;

FIG. 6 is a section view taken along the section line VI—VI shown in FIG. 5;

DESCRIPTION OF THE PREFERRED EMBODIMENTS

Figure 7:
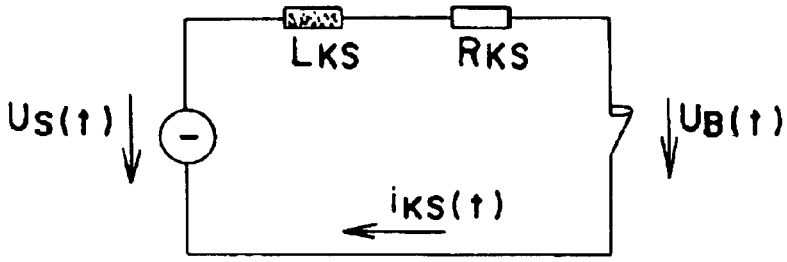
FIG. 7 is a circuit diagram of an equivalent circuit of an arc quenching chamber.

Referring now to the figures of the drawing in detail and first, particularly, to FIG. 1 thereof, there is shown a circuit breaker 10, in which the invention is used, by way of example. The circuit breaker 10 contains a switching mechanism 11, which is illustrated only schematically, is coupled on one side to a switching toggle 12 and on the other side to a moving contact lever 13, to which a moving contact piece 14 is fitted. The circuit breaker 10 also has an electromagnetic release 15, whose armature 16 moves the contact lever 13 to the open position when a short circuit occurs. Furthermore, the plunger-type armature 16 is connected to the switching mechanism 11, to be precise via a lever 17, so that, once the contact lever 13 has opened, the switching mechanism 11 holds the contact lever 13 open continuously.

Furthermore, the switching device or circuit breaker 10 contains a bimetallic strip 18, which acts as a thermal release and acts on the switching mechanism via a slide 19, so that the contact lever 13 is in this way held open.

The moving contact piece 14 interacts with a stationary contact piece 20 and, during a disconnection operation, that is to say when the contact lever 13 moves in the clockwise sense, an arc 21 is produced between the moving contact piece 14 and the stationary contact piece 20, and is fed to arc guide plates or rails 22 and a horn 23 to an arc splitter stack 24. The arc guide rail 22 is associated with the moving contact piece 14, and the arcing horn 23 is associated with the stationary contact piece 20.

The arc splitter stack 24 is shown in more detail in FIGS. 2 to 4 and has a number of arc splitter plates 25, a total of 11 are shown in the embodiment in FIG. 3 and which, as shown in FIG. 2, have an essentially rectangular shape, with an approximately V-shaped cutout 27 being provided on the narrow face edge 26 associated with the contact point 14, 20. The cutout 27 has parallel running edges 28 and 29 that open into the narrow face edge 26, as well as edges 30 and 31 that point toward one another in a V-shape. The tip of the V-shape of the cutout 27 has a tab 32 which points away from the contact point. The arc splitter stack 24 is surrounded by insulating paper 33. On the edges 34 and 35 which run parallel to the arc running direction, each arc splitter plate 25 has a recess 36, 37 which is slightly larger than the thickness of the insulating paper 33 and has tabs 38 and 39, which engage in corresponding openings 40 in the insulating paper 33 and thus serve to fix the arc splitter plates 25.

To this extent, the arc splitter stack is commercially available and prior art.

A plate 41 composed of an insulating material is incorporated into the arc splitter stack 24 and is introduced either in addition to the arcing plates or instead of one of the arcing plates 25. A circumferential contour 42 of the plate 41 corresponds to the circumferential contour of the arcing plates 25, and has an internal recess 44 that has or contains an inlet constriction area 45 and a widened area 46, with the inlet constriction area 45 opening in a V-shape toward the contact point. In this case, the V-shape is matched to the V-shape of the cutout 27.

The plate 41 is composed of plastic, preferably of a gas-evolving plastic, namely ultramide (A3 Sk) or PA (6—6).

FIG. 5 shows a plate 50 with a rectangular external contour 51 with two parallel longitudinal sides 52 and 53, as well as narrow face edges 54 and 55, running transversely with respect to the longitudinal sides 52 and 53, and an internal recess 56.

In the embodiment shown in FIG. 5, the internal recess 56 has an inlet constriction area 57, which is open to the contact point 14, 20, as well as a widened area 58. The inlet constriction area 57 in this case has parallel inner edges, which run parallel to the longitudinal edges 52 and 53; the internal contour of the widened area 58 is in this case rectangular. The inlet constriction area 57 and the widened area 58 are surrounded by thin closed lines 59, with the closed thin lines 59 being intended to indicate that these areas may also have different shapes. By way of example, FIG. 4 shows one shape; the two edges of the constriction area 57 may likewise widen in straight lines with a V-shape, and the internal contour of the widened area 58 could also be approximately in the form of a circular arc.

FIG. 6 shows a section view taken along the section line VI—VI shown in FIG. 5, with two arc splitter plates 25', 25" which are located alongside one another and between which the plate 50 is disposed. The arc 21 burns through the widened area 58 and acts on the material of the plate 50, so that this produces gas and results in a change in the atmosphere in the arc quenching chamber, or a change in the gas pressure.

FIGS. 9 to 13 will be used to describe an embodiment variant in which at least a part of the insulating plate is integrally formed on the inner face of the dielectric material enclosure of the switching device.

Figure 9:
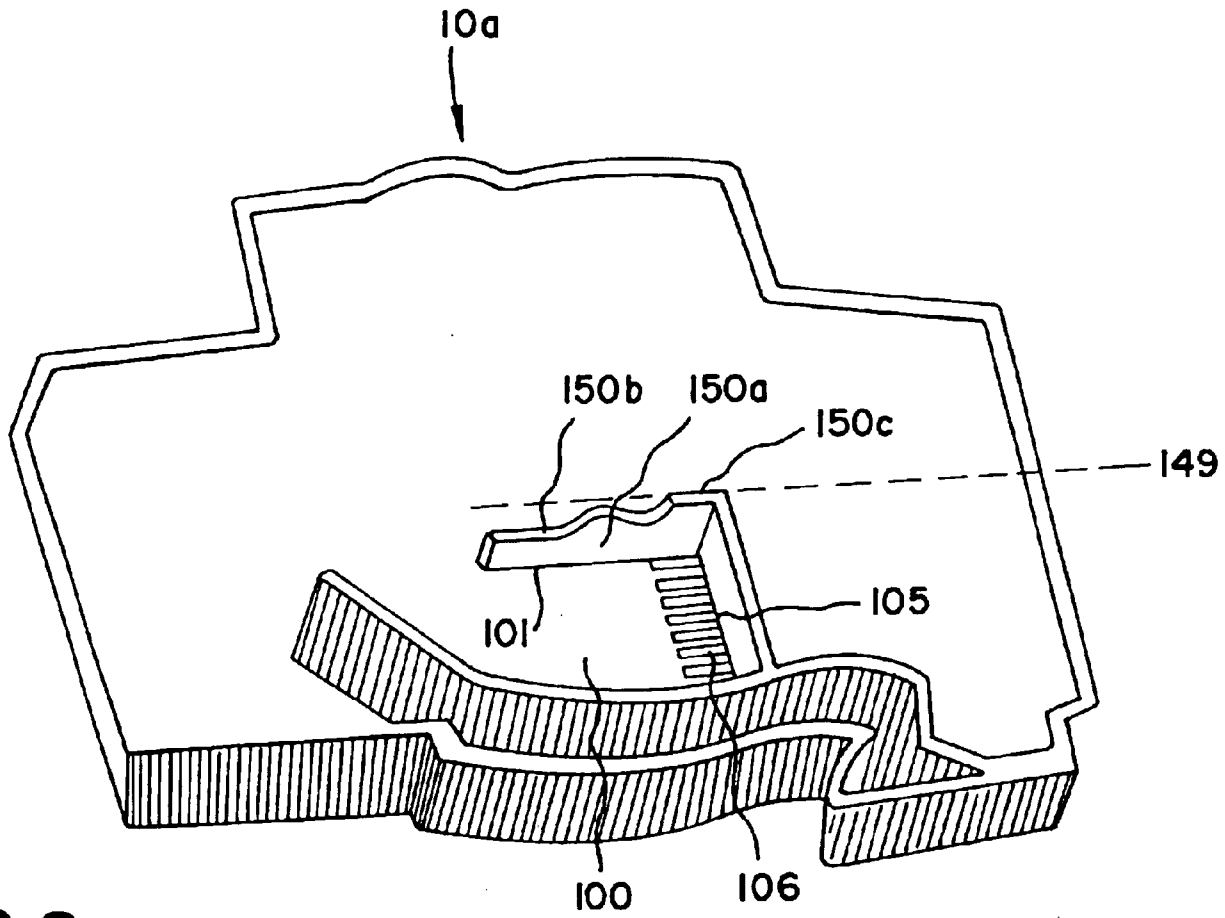
FIG. 9 is a perspective view into a part of the dielectric material enclosure with an integrally formed half of the insulating plate.

FIG. 9 shows a perspective view of the inner face of part of the dielectric material enclosure 10*a*. A holding device for the various components of the service switching device, which have already been described above, are provided on the inner face, in the form of recesses and bulges with widely differing geometries. Only an accommodation area 100 for the arc splitter stack will be described in more detail here. This is an essentially rectangular recess in the inner face of the enclosure part. Ribs 106 which project out of the inner face are integrally formed on a narrow face 105, with the spaces between the ribs 106 corresponding to the thickness of the arcing plates in the arc splitter stack, so that, when an arc splitter stack is inserted into the accommodation area 100, the arcing plates of the arc splitter stack are accommodated between the ribs 106, where they are guided and held. On a longitudinal face 101, the accommodation area 100 is bounded by a plate half 150*a* (which is integrally formed on the inner face of the enclosure part) of an insulating plate. The upper external contour line 150*b* of the plate half 150*a* is in this case shaped such that, when the external contour line is mirrored, this and its mirror image would be complementary to the internal contour line of the recess 58, 46 in the insulating plate 50, 41 as shown in FIGS. 4 and 5, and to the recess 158, 146 in an insulating plate 150, 141 (see FIGS. 10 to 13). The mirror-image axis is in this case an imaginary line 149, which runs parallel to the projection line of the internal contour line 150*b* to the broad face of the enclosure part 10*a*, and through that section 150*c* of the contour line 150*b* that is furthest away from the inner face of the enclosure part.

Figure 11:
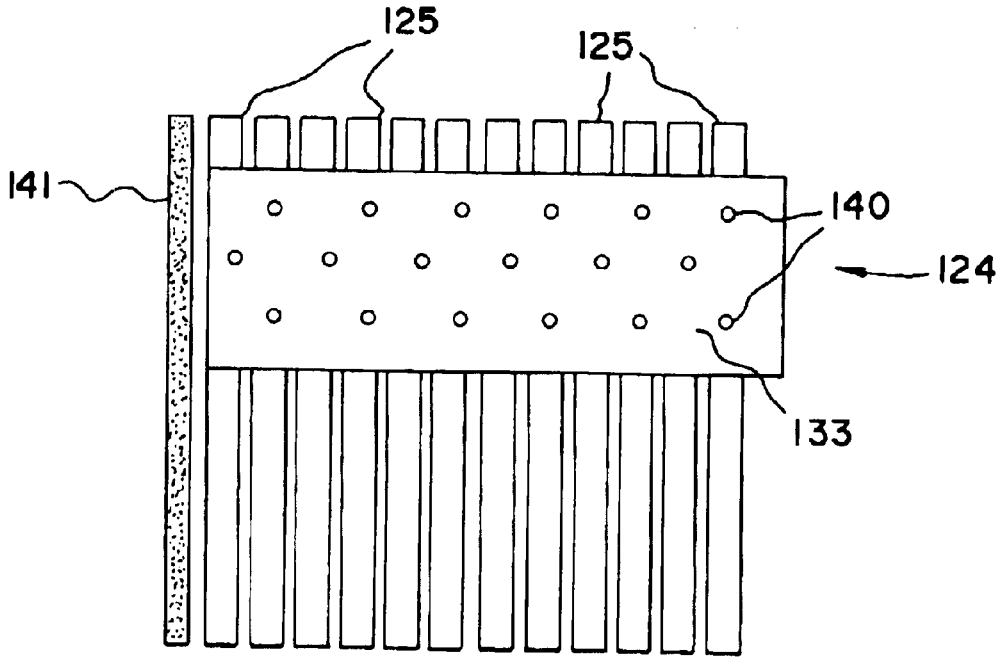
FIG. 11 is a side-elevation view of the arc splitter stack, containing a number of arcing plates corresponding to that shown in FIG. 2, and which is bounded at the side by an insulating plate that is integrally formed on the inner faces of the dielectric material enclosure.

FIG. 11 shows a cross section illustrating the association between an arc splitter stack 124 and the insulating plate 141 which is integrally formed on the dielectric material enclosure inner face. The arc splitter stack 124 in FIG. 11 is configured in a corresponding manner to the arc splitter stack 24 in FIG. 3. Parts having the same effect in FIG. 11 are provided with the reference symbols from FIG. 3, increased by 100.

Figure 10:
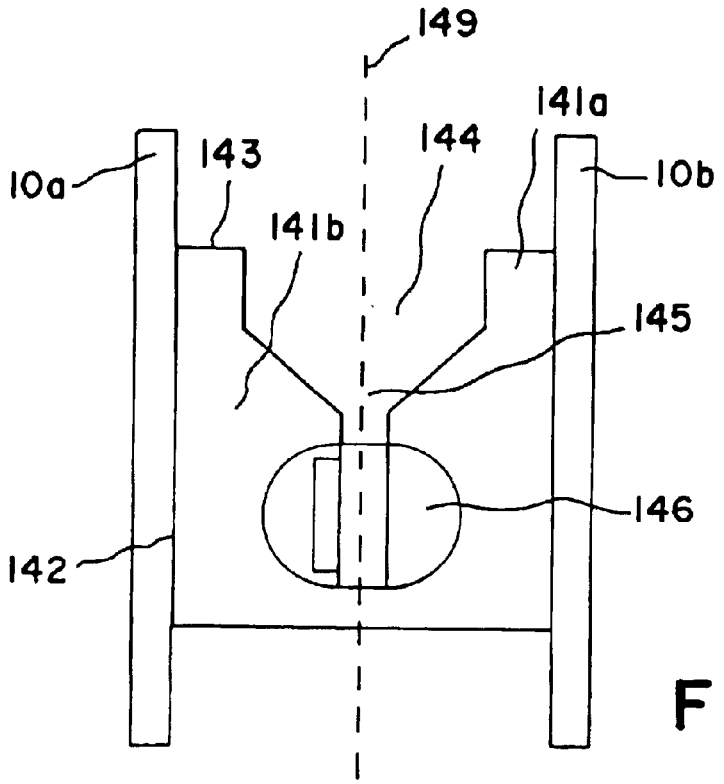
FIG. 10 is a plan view of a third embodiment of the insulating plate, integrally formed on the inner faces of the dielectric material enclosure.

This also applies to FIG. 10, which shows one possible refinement, corresponding to FIG. 4, for the insulating plate. The insulating plate 141 in FIG. 10 contains two halves 141*a* and 141*b*, which are disposed in mirror-image form with respect to the axis 149. Each of the two halves 141*a* and 141*b* is integrally formed on one of the inner faces 10*a*, 10*b* of the dielectric material enclosure. The circumferential contour 142 of the insulating plate 141 which is produced when the dielectric material enclosure is joined together corresponds to the circumferential contour of the arcing plates 125; it has an internal recess 144 which has or contains an inlet constriction area 145 and a widened area 146, with the inlet constriction area 145 opening toward the contact point in a V-shape. The V-shape is in this case matched to the V-shape of the cutout 27 in FIG. 2.

Like the plate 41, the plate 141 is composed of plastic, preferably of a gas-releasing plastic, namely PA 6 or PA (6—6). In particular, the plate 141 can be manufactured in the same process as the dielectric material enclosure, and together with it as one piece, and is then composed of the same material as the dielectric material enclosure.

Figure 12:
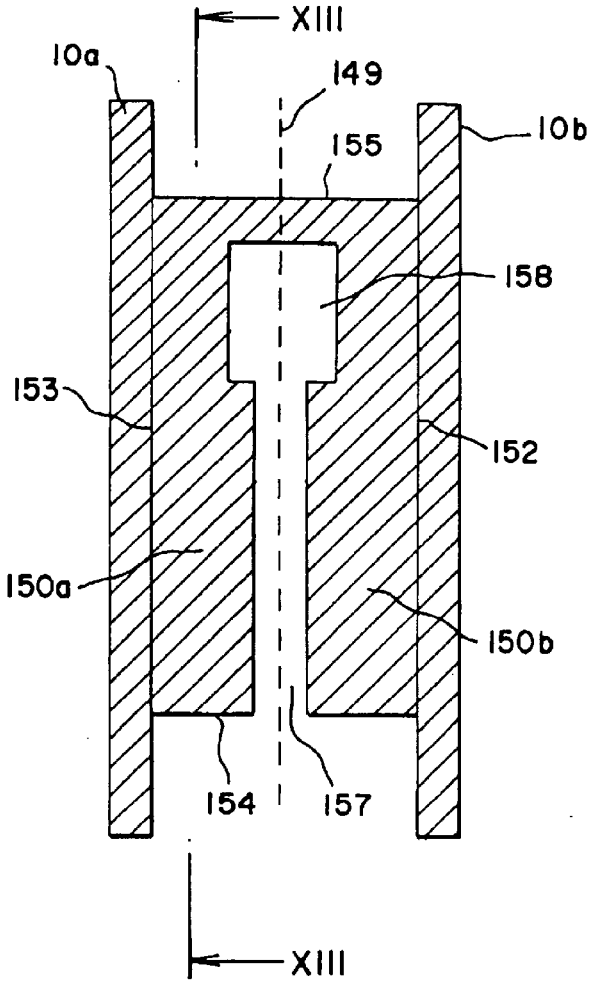
FIG. 12 is a plan view of a fourth embodiment of the insulating plate.

FIG. 12 shows the plate 150 whose external and internal contours are similar to those of the plate 50 in FIG. 5; however, the plate 150 is formed from two mirror-image identical halves 150*a* and 150*b*, which touch each other on the mirror-image axis 149, and with each of the two halves 150*a* and 150*b* being integrally formed on the respective inner face of one of the two dielectric material enclosure parts 10*a*, 10*b*. The contour parts, side parts and internal recesses in the plate 150 in FIG. 12 otherwise correspond to those of the plate 50 in FIG. 5; the respective reference symbol numbers are each increased by 100 in comparison to those in FIG. 5.

Figure 13:
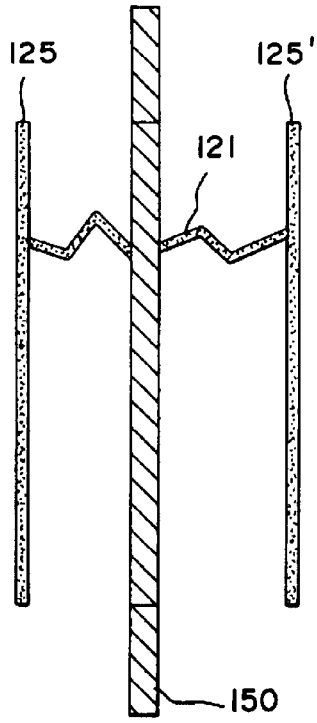
FIG. 13 is a section view taken along the section line XIII—XIII shown in FIG. 12.

FIG. 13 corresponds to FIG. 6 and shows a section view along the section line XIII—XIII in FIG. 12, with two arc splitter plates 125', 125" that are located alongside one another and between which the plate 150 is disposed. An arc 121 burns through the widened area 158 and acts on the material of the plate 150, so that it releases gas and produces a change in the atmosphere in the arc quenching chamber, and a change in the gas pressure.

FIG. 7 shows an equivalent circuit of an arc quenching chamber with $u_s(t)$ as the driving voltage, $u_b(t)$ as the arc voltage and $i_{ks}(t)$ as the short-circuit current. The designations $L_{ks}$ and $R_{ks}$ denote the inductance and resistance, respectively.

Figure 8:
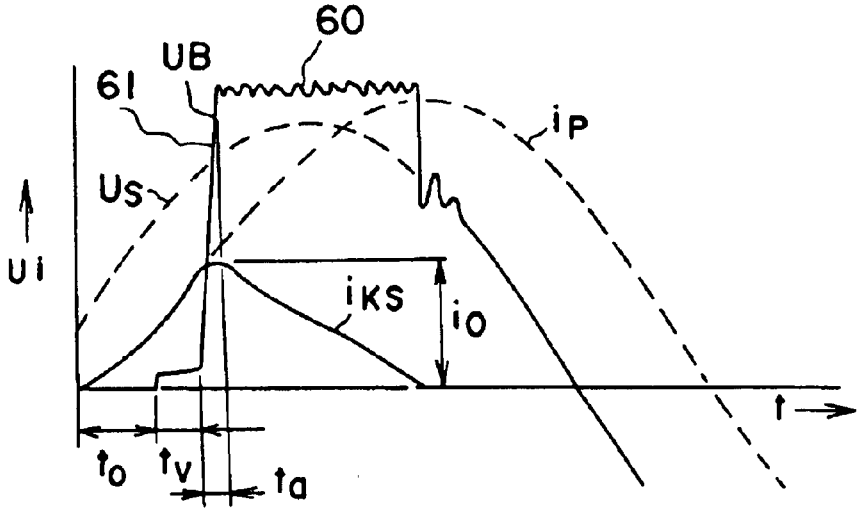
FIG. 8 is a graph in which current and voltage are plotted against time.

FIG. 8 shows a graph of a voltage u and of a current i against time t. In this case, the dashed line $u_s$ is the power supply system voltage, and $u_b$ is the arc voltage. As can be seen, once the contact point is opened and the arc has run into the quenching chamber, the arc voltage oscillates in the area 60, until it merges into the curve of the power supply system voltage $u_s$ once again once the arc has been quenched (see further below).

It is assumed that a short circuit occurs at t=0, with the prospective short-circuit current being $i_p$, After a switching delay of t=t0 and a so-called persistence time of t=tv, the arc voltage $u_b$ rises steeply in an area 61, in order then to merge into the area 60; this time period is referred to as the so-called arc voltage rise time. The current $i_p$ is then limited approximately at the time t=t0+tv+ta, to be precise as indicated by the line $i_{ks}$. The maximum value of the current $i_{ks}$ is the current flow which still flows through the switch after the short-circuit situation has occurred.

The current flow $i_D$ is limited by the plates 41 and 50.

The plate or plates can be firmly latched to the guide rail or to the rail that is adjacent to the fixed contact piece and acts as a horn.

We claim:

1. An arc quenching configuration for an electrical switching device, the electrical switching device having a dielectric material enclosure with side faces and formed from a lower part and an upper part in a plane parallel to the side faces, the arc quenching configuration comprising:

a stationary contact piece;

a moving contact piece;

an arcing chamber for producing an arc between said stationary contact piece and said moving contact piece during a switching operation, said stationary contact piece and said moving contact piece at least partially disposed in said arcing chamber;

guide rails leading from said arcing chamber;

an arc splitter stack having a number of arc splitter plates and disposed downstream of said guide rails, the arc passing between said guide rails into said arc splitter stack, said arc splitter plates having a given external circumference; and at least one further plate made of an insulating material and disposed in or in and adjacent to said arc splitter stack, said at least one further plate having an external circumference corresponding substantially to said given external circumference of said arc splitter plates, said at least one further plate further having an internal recess formed therein.

2. The arc quenching configuration according to claim 1, wherein said internal recess has an inlet constriction area and a widened area, said inlet constriction area being open to a contact point of said stationary contact piece and said moving contact piece.

3. The arc quenching configuration according to claim 2, wherein said inlet constriction area has straight boundary edges.

4. The arc quenching configuration according to claim 2, wherein said inlet constriction area widens in a V-shape toward the contact point.

5. The arc quenching configuration according to claim 2, wherein said widened area has an approximately rectangular internal contour.

6. The arc quenching configuration according to claim 2, wherein said widened area has an approximately circular internal contour.

7. The arc quenching configuration according to claim 1, wherein said internal recess is keyhole-shaped.

8. The arc quenching configuration according to claim 1, wherein said at least one further plate bounds said arc splitter stack on one side.

9. The arc quenching configuration according to claim 1, wherein said at least one further plate is integrally formed, one of entirely and at least in places, on an inner face of at least one part of the dielectric material enclosure of the electrical switching device.

10. The arc quenching configuration according to claim 1, wherein said at least one further plate has longitudinal sides and is divided into two halves along a division axis running parallel to the longitudinal sides and between them, with in each case one of said two halves being integrally formed on an inner face of one of the upper and lower parts of the dielectric material enclosure, so that, once the dielectric material enclosure containing the lower part and the upper part has been joined together, said two halves are joined together along the division axis to form said at least one further plate.

11. The arc quenching configuration according to claim 1, wherein said insulating material is a gas-releasing plastic.

12. The arc quenching configuration according to claim 11, wherein said gas-releasing plastic is PA 6 or PA 6—6.

13. The arc quenching configuration according to claim 1, wherein said at least one further plate is composed of an equivalent material as the dielectric material enclosure.

14. An arc quenching configuration for an electrical switching device, the electrical switching device having a dielectric material enclosure formed from a lower part and an upper part, the electrical switching device further having a stationary contact piece, a moving contact piece, an arcing chamber for producing an arc between the stationary contact piece and the moving contact piece during a switching operation, and guide rails leading from the arcing chamber, the arc quenching configuration comprising:

an arc splitter stack having a number of arc splitter plates and disposed downstream of the guide rails, the arc passing between the guide rails into said arc splitter stack, said arc splitter plates having a given external circumference; and at least one further plate composed of an insulating material and disposed in or adjacent to said arc splitter stack, said at least one further plate having an external circumference corresponding substantially to said given external circumference of said arc splitter plates, said at least one further plate further having an internal recess formed therein.

* * * * *